US005316439A

United States Patent [19]

Gatley, Jr. et al.

[11] Patent Number: 5,316,439

[45] Date of Patent: May 31, 1994

[54] NOISE CANCELLATION DEVICE FOR CENTRIFUGAL BLOWER

[75] Inventors: William S. Gatley, Jr.; Bobby D. Garrison, both of Cassville, Mo.

[73] Assignee: Fasco Industries, Inc., Cassville, Mo.

[21] Appl. No.: 111,016

[22] Filed: Aug. 24, 1993

Related U.S. Application Data

[63] Continuation of Ser. No. 881,998, May 12, 1992, abandoned, which is a continuation-in-part of Ser. No. 820,096, Jan. 13, 1992.

[51] Int. Cl.[5] ..... F04D 17/04

[52] U.S. Cl. ..... 415/119

[58] Field of Search ..... 415/119, 206, 211.2

[56] References Cited

U.S. PATENT DOCUMENTS

| | | | |
|---|---|---|---|
| 353,994 | 12/1886 | Walker et al. | 415/206 |
| 2,107,897 | 2/1938 | McMahan | 415/119 X |
| 2,109,742 | 3/1938 | Fanning | 415/119 |
| 2,171,342 | 8/1939 | McMahan | 415/119 |
| 3,477,635 | 11/1969 | Glucksman et al. | 415/119 X |
| 4,078,870 | 3/1978 | Keller et al. | 415/119 X |
| 4,419,049 | 12/1983 | Gerboth et al. | 415/119 X |

FOREIGN PATENT DOCUMENTS

| | | | |
|---|---|---|---|
| 466983 | 1/1992 | European Pat. Off. | 415/119 |
| 118095 | 5/1987 | Japan | 415/119 |
| 656430 | 8/1951 | United Kingdom . | |

*Primary Examiner*—Edward K. Look
*Assistant Examiner*—Mark Sgantzos
*Attorney, Agent, or Firm*—Lorusso & Loud

[57] ABSTRACT

A noise cancellation device for a centrifugal blower comprises, in a first embodiment, a rod mounted in the output of a blower and generally axially parallel to the impeller so that as the impeller rotates, the blades of the impeller sweep past the rod much as in the manner that the blades sweep past the cutoff section of the blower output. The rod is positioned a specified distance away from the cutoff such that it generates a tone which interferes with the pure tone otherwise generated by the impeller blades sweeping past the cutoff in an out of phase condition to thereby eliminate the pure tone or "spike" normally experienced at a fundamental frequency and harmonics thereof. In a second embodiment, a nose-like projection extends inwardly from a sidewall of said blower housing and is positioned substantially in the same position as the rod of the first embodiment. The nose-like projection may be integrally formed as part of the blower housing.

9 Claims, 2 Drawing Sheets

FIG. 1.
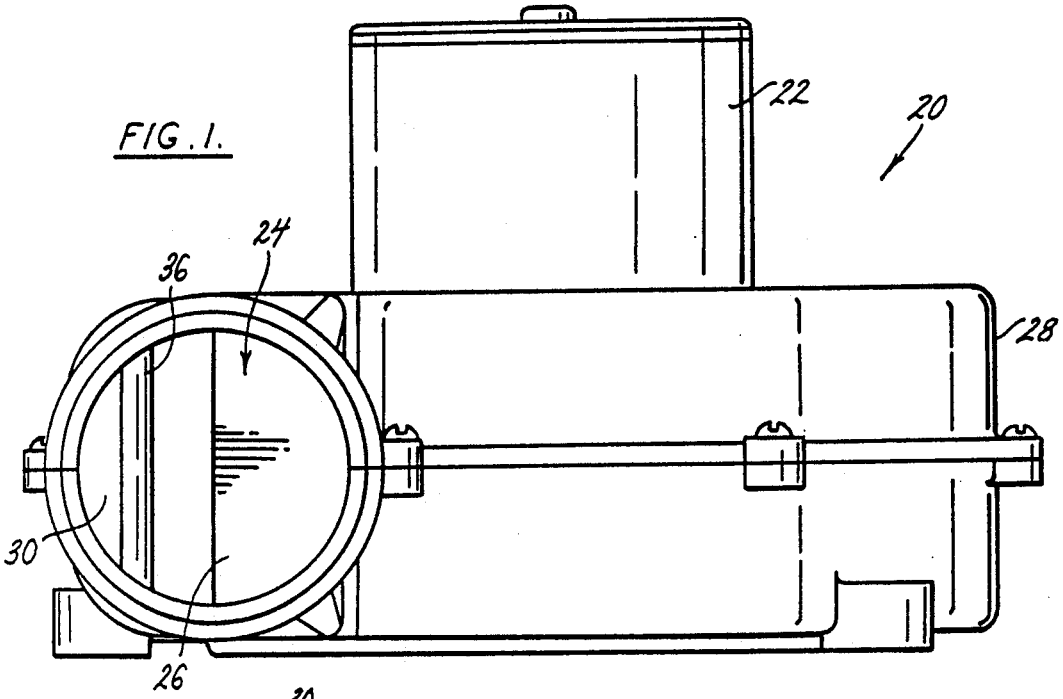
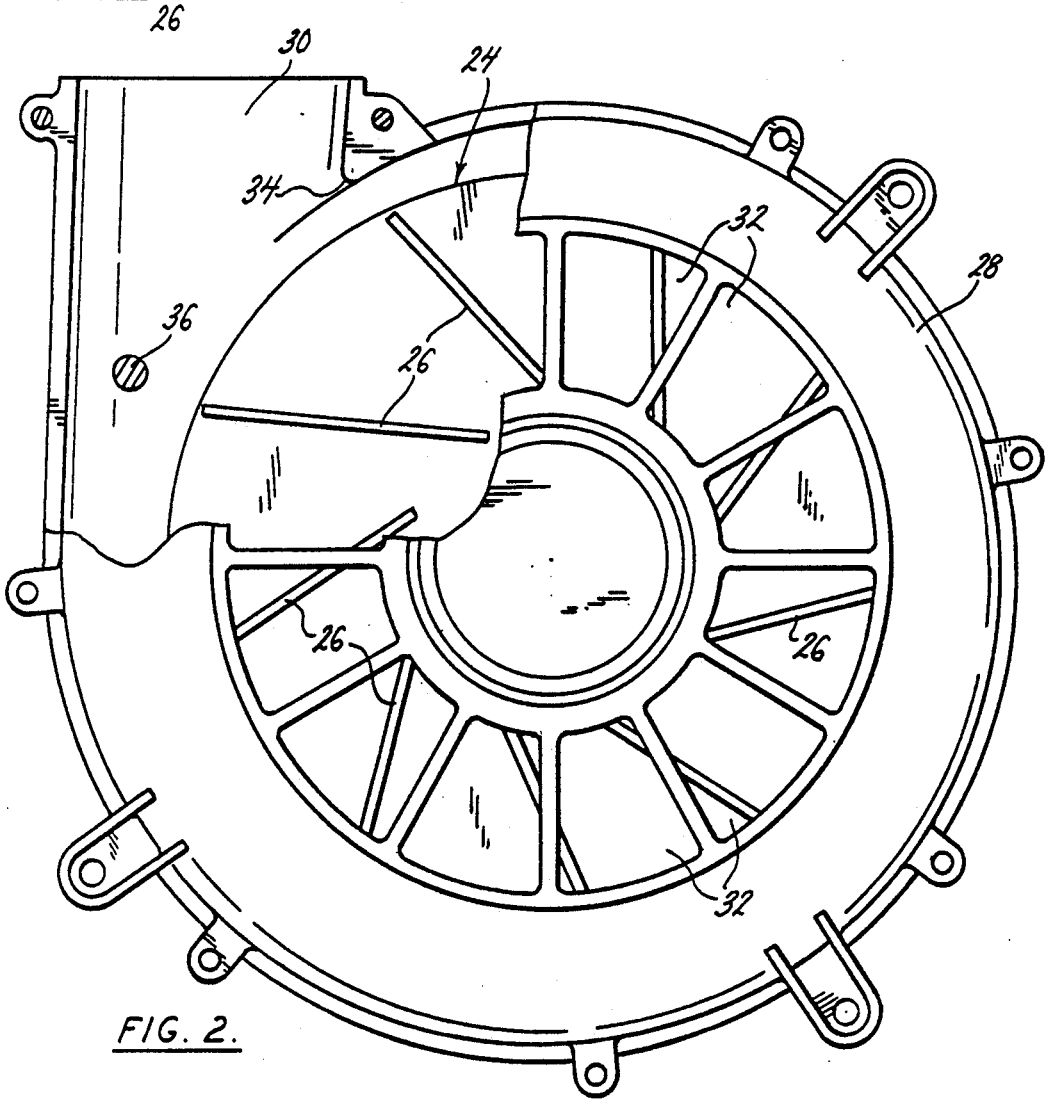
FIG. 2.

FIG. 3.
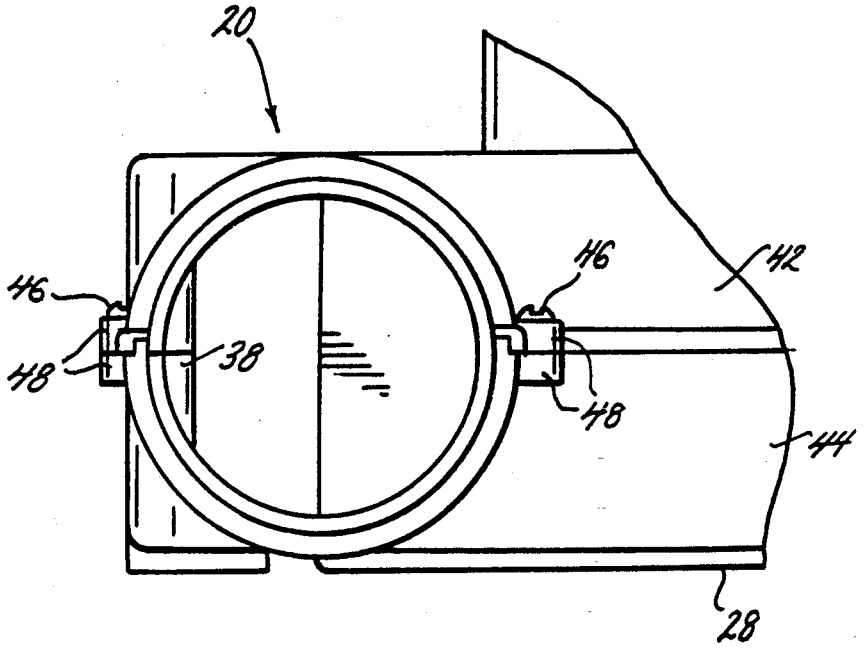
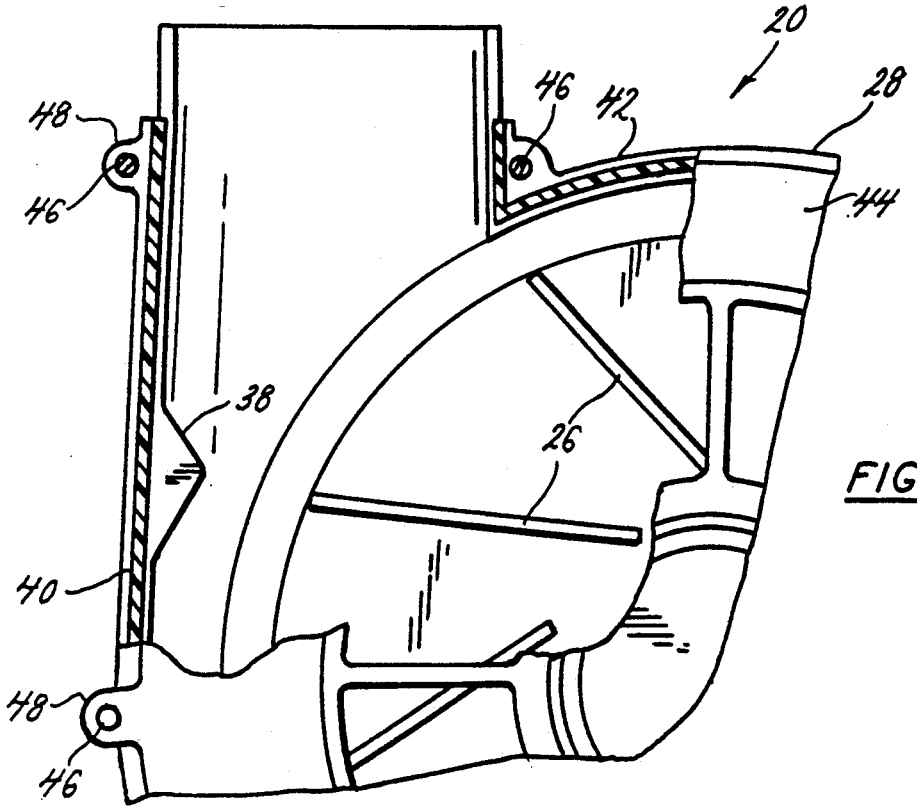
FIG. 4.

NOISE CANCELLATION DEVICE FOR CENTRIFUGAL BLOWER

CROSS REFERENCE TO RELATED APPLICATION

This is a continuation of copending application Ser. No. 07/881,998 filed on May 12, 1992, now abandoned, which is a continuation in part of USSN 07/820,096 filed Jan. 13, 1992 in the names of William S. Gatley, Jr. and Bobby D. Garrison.

Background of the Invention

1. Field of the Invention

The invention relates to centrifugal blowers, and is directed more particularly to a centrifugal blower having therein means for reducing the noise of operation of the blower.

2. Description of the Prior Art

Centrifugal blowers, also known as scroll-type blowers, sirocco blowers, etc. are well known in the art and include a generally cylindrically shaped impeller or blower wheel having a plurality of blades, the impeller being rotatably mounted within a housing. The blades are oriented in the impeller such that as it is rotated in a specific direction, air is drawn in axially into the interior of the impeller and blown radially outwardly by its blades, and then through a tangential output at increased pressure. This tangential outlet is formed in the housing of the blower and includes a sharply radiused edge or cutoff. This cutoff edge is typically positioned closer to the impeller than any other part of the blower housing and defines a sharp separation between the output and the interior of the blower housing.

As a result of the impeller rotating at relatively high speeds past this cutoff, an interaction is created therebetween which produces a pure tone, or whistling noise, at a fundamental frequency. This fundamental frequency has been empirically determined as the speed of the blower wheel in RPM, divided by 60, multiplied by the number of blades contained in the impeller. In a typical impeller consisting of nine blades operated at 3,433 RPM, the fundamental blade pass frequency, or pure tone frequency, is 515 Hz. In addition to the fundamental frequency, this particular design also has a second harmonic tone at 1030 Hz, a third harmonic at 1545 Hz, etc., as is well known in the art. These pure tones represent frequencies of dramatically increased amplitude over the average or "white" noise ordinarily produced by the motor and blower in connection with its rotating action. As is well known, these pure tones of increased amplitude are also produced at each of the harmonics, including the third and fourth harmonic, which can generate tones which are particularly annoying to a human ear. For example, a fourth harmonic of the example noted above occurs at approximately 2,060 Hz which is an ear-piercing sound particularly bothersome at these increased amplitudes. Therefore, there typically is a significant amount of design activity and effort expended to try and eliminate these pure tones. However, the inventors herein are not aware of any ready solution to this problem, until now.

SUMMARY OF THE INVENTION

To solve these and other problems in the prior art, the inventors herein have succeeded in designing and developing a noise control device which effectively cancels the pure tones previously created in a centrifugal blower by revolution of the impeller and movement of the blades past the cutoff.

In a first embodiment, this noise control device essentially comprises a rod which extends parallel to the blades and parallel to the cut-off, the rod being positioned in the outlet of the blower, and generally adjacent the impeller, so that it generates a noise substantially equal to, but out of phase with, the blade pass noise or pure tone created by the cutoff.

In a second embodiment, a nose-like projection is integrally formed on, and extends inwardly from, the sidewall of the blower housing. Although the inventors have utilized these two arrangements in prototyping the invention, it is believed that other structures would also work, some perhaps better than that being utilized.

The rod is positioned approximately one-tenth of a wavelength of the fundamental frequency away from the cutoff. This initial position is moderated or adjusted by moving the rod radially outwardly from the impeller, and at the same time edging it closer to the cutoff, so as to minimize its interference with the output air stream from the blower. It is believed that the noise generated by the rod as the blades pass thereby is substantially equal to that produced at the cutoff. However, as the noise wave fronts meet, or interfere with each other, at some point therebetween, they are 180° out of phase so that they effectively cancel one another.

The second embodiment of the present invention is comprised of a nose-like projection which extends inwardly from the sidewall of the blower housing. With this embodiment, the same effect is achieved as with the first embodiment of the rod. However, it is anticipated that greater ease in manufacturing will be achievable in that the blower halve may each be molded with the nose-like projection as part of the blower sidewall such that as the blower halves are assembled, the nose-like projection is formed, and no additional manufacturing steps are required. With the rod of the first embodiment, as contemplated by the inventors, additional manufacturing steps might be required to properly place the rod inside the blower housing and fix it in position. The nose-like projection of this embodiment eliminates those contemplated extra manufacturing steps, and is seen to achieve the same noise cancellation results.

A prototype blower was built and tested with the noise cancellation rod embodiment of the present invention and the noise generated thereby was compared with a second blower of the exact same construction but without the noise cancellation rod. A pure tone was measured in the standard production blower at 512 Hz with a 70.3 dB level and a second harmonic at 1024 Hz with a level of 74.6 dB. The noise levels at this fundamental and second harmonic frequencies were "spike" levels which rose substantially above the baseline of average or white noise generated by the blower across the frequency spectrum. The blower which included the noise cancellation rod of the present invention was effective in minimizing the spikes or pure tones experienced in the production blower first tested. For example, at the 512 Hz fundamental frequency, a dB level of 54.1 was measured and at the second harmonic of 1024 Hz, a dB level of 60 was measured. At these two tones, dB levels were reduced by 16.2 and 14.6 dB, respectively. Additionally, it should be noted that the dB levels at these particular frequencies were in line with the dB levels for adjacent frequencies such that no "pure tone" was generated.

While the principal advantages and features of the present invention have been described above, a more complete and thorough understanding of the invention may be attained by referring to the drawings and description of the preferred embodiment which follow.

BRIEF DESCRIPTION OF THE DRAWINGS

FIG. 1 is a side elevational view of an illustrative centrifugal blower, looking into the output thereof, and showing the position of the rod with respect to the impeller;

FIG. 2 is a plan view of the centrifugal blower of FIG. 1, partially broken away to further illustrate the placement of the noise cancellation rod with respect to the impeller;

FIG. 3 is a partial side elevational view of the centrifugal blower housing, looking into the output thereof, and illustrating the position of the nose-like projection; and FIG. 4 is a partial plan view of the centrifugal blower of FIG. 3 partially broken away to further illustrate the position of the nose-like projection in the blower output.

DETAILED DESCRIPTION OF THE PREFERRED EMBODIMENT

As shown in FIG. 1, a typical centrifugal blower 20 includes a drive motor 22 with an impeller 24 having a plurality of blades 26 mounted thereon and contained within a housing 28. The blower housing 28 has an outlet 30 through which air is blown after being axially drawn in through various openings 32 (see FIG. 2). A cutoff 34 separates the output 30 from the rest of the housing 28 and, as shown in FIG. 2, is closely aligned with the edge of the impeller 24, such that as the blades 26 pass thereby, there is a tendency for a pure tone to be generated having a blade pass frequency, as explained above.

In accordance with the teachings of the first embodiment of the present invention, a noise cancellation rod 36 is mounted in the outlet 30 of the blower housing 28 and extends generally axially, parallel to the impeller 24, and is oriented from the cutoff 34 at a distance approximately equal to one-tenth of the wavelength of the pure tone generated in a blower not having the noise cancellation rod 36 of the present invention. This distance is measured along a chord from the edge of the cutoff 34 to the noise cancellation rod 36.

Although the noise cancellation rod 36 is shown in FIG. 2 to be substantially adjacent the impeller 24 and the blades 26, a relatively small adjustment in its position may be made by moving it radially away from the edge of the impeller 24 and closer to the cutoff 34 to thereby maintain its ability to generate a noise effectively 180° out of phase with the pure tone, but also present less interference to the normal output of air by the impeller 24 through the outlet 30.

As shown in FIGS. 3 and 4, a second embodiment of the present invention includes a nose-like projection 38 which is integrally formed with and extends radially inwardly from a sidewall 40 of the blower housing 28. As best shown in FIG. 3, the blower housing 28 may be conveniently constructed of two halves 42, 44 which may be molded from plastic, or separately formed from metal, or otherwise separately constructed and assembled with screws 46 for joining threaded bosses 48. Thus, with the structure as shown in FIGS. 3 and 4, the nose-like projection 38 may be conveniently formed along with each blower housing half 42, 44 and thereby be assembled along with the blower housing halves 42, 44. This construction eliminates any extra steps such as might be required, depending upon the particular manufacturing processes and materials used, for the first embodiment of the noise cancellation rod 36.

The nose-like projection 38 generally extends to substantially the same position as substantially defined by the periphery of noise cancellation rod 36 of the first embodiment. Again, as with the first embodiment, limited adjustment may be required, depending upon other particular details of construction of the blower 20, including blower speed.

Although a rod 36 and a projection 38 are shown, and the inventors have not tested other shapes or sizes of structure, it is believed that a rod-like shape is not critical to the operation of the present invention and that other shapes may function equally well, if not better. Additionally, the inventors contemplate that the present invention may be used on blowers other than those mounted in a housing and which may be open, or in housings other than centrifugal housings.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. In a device having means for blowing air from an inlet to an outlet, said blowing means including a rotatable impeller having blades mounted thereon, said inlet being disposed to ingest air axially of said impeller, said outlet being disposed to discharge air generally tangentially of said impeller, said device including a first stationary structure formed in part by a first outlet wall and aligned with said impeller such that as said impeller is rotated said blades sweep past said first stationary structure to create a first noise at a fundamental frequency, the improvement comprising a second stationary structure fixed in the outlet, spaced from said first stationary structure, and on a second outlet wall opposite from said first outlet wall, and aligned with said impeller, said second stationary structure having means for creating a second noise at said fundamental frequency, said second noise interfering with and being out of phase with, said first noise to thereby substantially reduce the intensity of said first noise, wherein said second stationary structure comprises a projection having only a single elongated base portion fixed to said second wall of said outlet, and having walls inclined from said base portion toward each other and extending from said base portion inwardly of said outlet toward said impeller to form a ridge adjacent said impeller defining a constriction in said outlet between said projection and said impeller.

2. In a centrifugal blower including a blower housing having an air outlet, an impeller having blades thereon and rotatably mounted within said housing, said housing having therein a cutoff formed in part by a first outlet wall and at least partially defining said air outlet, said blower generating a first pure tone noise at a fundamental frequency as said blades pass by said cutoff, the improvement comprising a projection fixed to a second outlet wall opposite from said first outlet wall of said blower housing and extending from said second wall of said blower housing inwardly of said air outlet, said projection being spaced from said cutoff and positioned in said outlet with respect to said impeller such that said blades are adapted to generate in cooperation with said projection as said blades pass by said projection a second pure tone noise at said fundamental frequency, said second noise interfering with and being out of phase with said first noise to thereby substantially reduce the intensity of said first noise.

3. The blower in accordance with claim 2 wherein said projection is disposed at a radial position from said blades so as to define a constriction in said outlet between said blades and said projection.

4. The blower in accordance with claim 3 wherein said projection is positioned a distance of about one-tenth of the wavelength of said fundamental frequency from said cutoff.

5. The blower in accordance with claim 4 wherein said projection is disposed further from the center of said impeller than said cutoff, and extends toward said cutoff.

6. In a centrifugal blower including a blower housing having an air inlet, a blower impeller rotatably mounted within said blower housing, and a cutoff formed at least in part by a first outlet wall and at least partially defining said air outlet, said blower in operation generating a first pure tone noise at a fundamental frequency as said blower impeller rotates past said cutoff, the improvement comprising a projection extending inwardly from a second outlet wall of said blower housing, said projection being spaced from said cutoff disposed on said second outlet wall opposite from said cutoff in said air outlet and defining a ridge extending transversely across a portion of said outlet, said ridge being parallel to and adjacent to free distal edges of blades mounted on said impeller, said blades in operation generating a second pure tone noise at said fundamental frequency as said blade free distal edges rotate past said ridge, which second noise interacts with and substantially reduces said first pure tone noise.

7. The blower in accordance with claim 6 wherein said projection is positioned a distance of about one-tenth of the wavelength of said fundamental frequency from said cutoff.

8. The blower in accordance with claim 7 wherein said projection is positioned at the same distance from the center of said impeller as said cutoff.

9. The blower in accordance with claim 7 wherein said projection is positioned further from the center of said impeller than said cutoff.

* * * * *